United States Patent [19]

Sasakura et al.

[11] Patent Number: 4,795,674

[45] Date of Patent: Jan. 3, 1989

[54] METHOD FOR TREATING A FABRIC AND FABRIC TREATED THEREBY

[75] Inventors: Tadao Sasakura, Saitama; Otohiko Yamazoe, Sanda; Sachio Othuka; Tetsuro Ikeda, both of Itami; Masaru Daimon, Takarazuka; Shinjuro Tamura, Itami, all of Japan

[73] Assignee: Nitto Boseki Co., Ltd., Fukushima, Japan

[21] Appl. No.: 62,173

[22] Filed: Jun. 12, 1987

[30] Foreign Application Priority Data

Jun. 13, 1986 [JP] Japan ..... 61-137695
Dec. 11, 1986 [JP] Japan ..... 61-295168
Apr. 15, 1987 [JP] Japan ..... 62-92554

[51] Int. Cl.[4] ..... D04H 1/58

[52] U.S. Cl. ..... 428/254; 427/393.3; 427/394; 428/264; 428/288; 428/290; 428/289; 428/921

[58] Field of Search ..... 428/264, 290, 254, 921, 428/288, 289; 427/393.3, 394

[56] References Cited

U.S. PATENT DOCUMENTS 2,782,133 2/1957 Vallette ..... 428/921

*Primary Examiner*—Marion C. McCamish
*Attorney, Agent, or Firm*—Bert J. Lewen; Henry Sternberg

[57] ABSTRACT

An aqueous solution containing at least an amido-phosphazene compound and an acid catalyst is applied to a fabric comprising cellulosic fibers so that said amido-phosphazene compound adheres to the fabric in an amount of 1–10% by weight of the fabric and then thus treated fabric is subjected to drying, curing and soaping, thereby obtaining a fabric having soft hand and low in shrinkage after repeated washings which contains less than 6% of amido-phosphazene and less than 10 $\mu$/g of free formaldehyde and is less than 4% in shrinkage after washings of 45 times.

11 Claims, No Drawings

METHOD FOR TREATING A FABRIC AND FABRIC TREATED THEREBY

BACKGROUND OF THE INVENTION

This invention relates to a method for treating a fabric which comprises applying an aqueous solution containing at least an amido-phosphazene compound and an acid catalyst to a fabric containing cellulosic fiber at an application amount of the amido-phosphazene compound of 1–10% by weight and then subjecting it to drying, curing and soaping and the fabric comprising cellulosic fibers obtained by said method which has a soft hand and is very small in shrinkage after repeated washings and is non-formaldehyde type.

U.S. Pat. No. 2,782,133 discloses a flameproofing of cellulosic articles with a water-soluble substance obtained by reacting chlorophosphazene with anhydrous ammonia, but makes no mention of improvement of progressive shrinkage of fabrics containing cellulosic fibers using a small amount of an amido-phosphazene compound.

There have been employed methods for improving progressive shrinkage of fabrics containing cellulosic fibers with aminoplast resin treating agents such as urea-formaldehyde, melamine-formaldehyde, methylated methylolmelamine, dimethylolethyleneurea, dimethyloluron, tetramethylolacetylenediurea, dimethylol triazone, trimethylolmelamine, etc. or glyoxal resin treating agents. However, it is well known that thus obtained fabrics liberate formaldehyde to cause skin troubles.

Recently, non-formaldehyde resins have been sold for avoiding these troubles, but these resins are less in effect of preventing shrinkages caused by repeated washings.

Fabrics containing cellulosic fibers have the defect of so-called progressive shrinkage which means gradual increase of shrinkage with increase of the number of washing and improvement in the progressive shrinkage has been desired.

SUMMARY OF THE INVENTION

The inventors have made intensive researches in an attempt to solve the above defects in the conventional fabric comprising cellulosic fibers and as a result it has been found that fabrics comprising cellulosic fibers which show a little shrinkage after repeated washings are obtained by applying amidophosphazene compounds to the fabrics and then heat treating them. Thus, the present invention has been accomplished.

That is, this invention relates to a method for treatment of a fabric containing cellulosic fibers which comprises applying an aqueous solution containing at least an amido-phosphazene compound and an acid catalyst to the fabric so that the amido-phosphazene compound adheres to the fabric in an amount of 1–10% by weight of the fabric and then subjecting the fabric to drying, curing and soaping and further relates to thus obtained fabric comprising cellulosic fibers, characterized in that amount of the amido-phosphazene compound which adheres to the fabric is 6% or less based on the weight of untreated fabric, amount of free formaldehyde is 10 μg/g or less and shrinkage after washings of 45 times is 4% or less.

DETAILED DESCRIPTION OF THE INVENTION

Fabrics containing cellulosic fibers show progressive shrinkage and are limited in their use. However, according to this invention, the above defects of fabrics containing cellulosic fibers can be solved by applying an aqueous solution containing at least an amido-phosphazene compound and an acid catalyst so that the adhering amount of the amido-phosphazene compound to the fabrics is 1–10% by weight, followed by drying, curing and soaping.

The inventors have made researches on flameproofing treatment of fabrics containing cellulosic fibers with amido-phosphazene compound and filed patent applications thereon [Japanese patent application Nos. 103388/85 (Unexamined Publication No. 266669/86), 103389/85 (Unexamined Publication No. 266670/86), 219611/85 and 34799/86]. In these patent applications, amido-phosphazene compound is applied to fabrics in an amount of more than about 10% by weight, followed by drying, curing and soaping thereby satisfy the flameproofness. During the course of the research, the inventors have found that application of 1–10% by weight of amido-phosphazene compound to the fabrics results in remarkable improvement of progressive shrinkage of fabrics containing cellulosic fibers.

Furthermore, according to this invention, creasing (wrinkle) and fluffing are also improved in addition to improvement in progressive shrinkage. Base materials for non-formaldehyde low shrinkage fabrics of this invention are cellulosic fibers which include, for example, viscose rayon filaments, viscose rayon staples, high-tenacity viscose rayon filaments, high-tenacity viscose rayon staples, polynosics, cupra filaments, cupra staples, cotton, ramie, linen, etc. Furthermore, said base materials may additionally contain a small amount of other fibers such as organic synthetic fibers such as polyamide, polyester, polyacrylonitrile, polypropylene, spandex, etc., and inorganic synthetic fibers such as glass fibers, carbon fibers, silicon carbide fibers, etc.

The fabrics used in this invention may be in any forms such as woven fabric, knitted fabric, non-woven fabric, resin-treated fabric, sewed fibrous articles, etc.

Method for making non-formaldehyde low shrinkage fabrics of this invention will be explained below.

A fibrous fabric is treated with an aqueous solution containing an amido-phosphazene compound and an acid catalyst including Lewis acid.

Said amido-phosphazene compounds include cyclic amido-phosphazenes represented by the general formula $$\left(N=\overset{\overset{NH_2}{|}}{\underset{\underset{NH_2}{|}}{P}}\right)_x \qquad (1)$$

(wherein x is an integer of 3 or more) and linear amido-phosphazene compounds represented by the general formulas $P_nN_n(NH_2)_{2n}$ (2) and $P_nN_{n-1}(NH_2)_{2n+3}$ (3) (wherein n is a positive integer) which can be in the form of aqueous solution.

Preferred cyclic amido-phosphazene compounds are 6-membered ring compounds of the following formula (4) and additionally 8-, 10- and 12-membered ring compounds are also preferred.

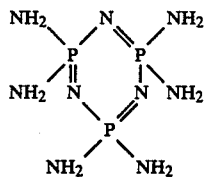

(4)

As preferred linear amido-phosphazene compounds, mention may be made of those represented by the following formulas (5)-(9), but those of higher polymers may also be used. With increase of polymerization degree of amido-phosphazene compounds, hand of the treated fabrics tends to become harder, but progressive shrinkage is improved. The 6-membered compound of formula (4) is especially preferred with reference to hand of the treated fabrics. Furthermore, amido-phosphazene compounds where a small amount of amido groups (—$NH_2$) are substituted with other substituents such as —Cl, —$OCH_3$, —$OC_2H_5$, —$OC_3H_7$, —OH, etc. and which can be in the form of aqueous solution may also be included in the amido-phosphazene compounds used in this invention.

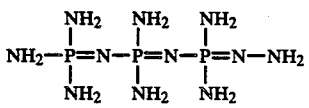

(5)

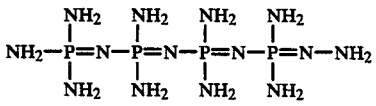

(6)

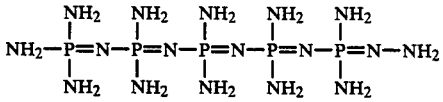

(7)

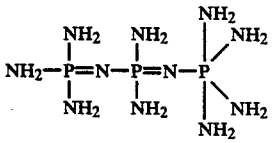

(8)

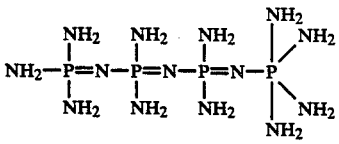

(9)

As acid catalysts containing Lewis acid, there may be used any of those which are used for resin treatment of fabrics. For example, preferably used are ammonium secondary phosphate, ammonium chloride, organic amine hydrochlorides, zinc chloride, magnesium chloride, zinc nitrate, zinc borofluoride, hydrochloric acid, phosphoric acid, etc. which are used for aminoplast resin treating agents such as urea-formaldehyde, melamineformaldehyde, methylolated methylolmelamine, dimethylolethyleneurea, dimethyloluron, tetramethylolacetylenediurea, dimethyloltriazone, trimethylolmelamine, etc. and glyoxal resin treating agents.

The aqueous treating solutions referred to here include those which use solvents composed of 100% water or mainly composed of water and a solvent containing a small amount of organic solvents compatible with water such as N,N-dimethylformamide, ethyl alcohol, acetone, etc. may also be used.

The aqueous solution contains at least one amido-phosphazene compound and at least one acid catalyst. Further, a small amount of resin treating agent, softener, penetrating agent, water repellent and/or cellulose crosslinking agent may also be added in addition to the amido-phosphazene compound and acid catalyst.

Concentration of amido-phosphazene compound in the treating solution is preferably 0.5–15% by weight, more preferably 1–10% by weight. Concentration of the acid catalyst is preferably 0.01–14% by weight, more preferably 0.1–10% by weight.

The fabrics containing cellulosic fibers of this invention hold the treating solution and amount of amido-phosphazene compound adhering to fabrics is 1–10% by weight after subjected to pressing. When the adhering amount is less than 1% by weight, the compound does not give satisfactory effect on progressive shrinkage. When more than 10% by weight, substantially no increase of effects is seen on progressive shrinkage and creasing and rather there occur the problems such as reduction of abrasion resistance, yellowing and increase in cost of chemical agents. Especially, in the case of fabrics comprising regenerated fibers, when the adhering amount exceeds 10% by weight, reduction of abrasion resistance and yellowing are conspicuous and commercialization of fabrics is difficult. The range is preferably 2–9% by weight, more preferably 3–7% by weight.

Treatment of fabric with aqueous solution containing amido-phosphazene and acid catalyst may be carried out by, firstly, dipping the fabric in the aqueous solution and drying the fabric as it is or after squeezed by roll or mangle or spraying or coating the aqueous solution onto fabric and then drying the fabric. Dipping of fabric in the aqueous solution may be carried out under heating or with adjusting pH to weakly acidic-weakly alkaline values. Drying may be effected by air-drying at room temperature or hot-air drying. Drying temperature and time may be optionally selected so long as fabrics are not damaged.

Secondly, curing is carried out. Curing temperature is preferably 130°–190° C. and curing time is preferably 1–10 minutes, but these may be optionally selected so long as fabrics are not damaged. The curing may be carried out simultaneously with drying referred to above. When the curing temperature and time are insufficient, the amido-phosphazene compound which adheres or is adsorbed to fabric considerably falls off at the subsequent neutralizing and washing with warm water.

A part of amido-phosphazene compound becomes water-insoluble by curing and is filled in cellulosic fibers to give the effect in this invention.

Thirdly, neutralization and washing with warm water or water are carried out. These are for removing acid catalyst which adheres or is adsorbed to fabric. These steps may be omitted if amount of the acid catalyst is small.

A part of amido-phosphazene compound falls off by the neutralization and washing with warm water. Preferable amount of amido-phosphazene compound which adheres to the fabric after the neutralization and washing with warm water is 1.2–6.0% by weight. Preferable phosphorus content in the fabric after the neutralization and washing with warm water is 0.5–2.4% by weight. When amount of amido-phosphazene compound is too small, the treated fabric does not show sufficiently low shrinkage after washings of 45 times and too large amount of amido-phosphazene compound causes reduction of tenacity and further is not economical. Amido-phosphazene compound does not contain formaldehyde and thus the treated fabric also does not contain formaldehyde. Substantially no hardening of fabric occurs by treatment.

As is also clear from the method of production of the fabric of this invention, the non-formaldehyde low shrinkage fabric of this invention generates no free formaldehyde and is very small in shrinkage caused by repeated washings and hence is very useful as clothes which contact with skin and requires washing such as underwears for infants, sportswears, pajamas, lingerie, etc.

Methods of measurements used in Examples 1–8 will be explained below.

(1) Progressive Shrinkage (a) Preparation of Test Sample and Test Pieces

A test piece of 40×40 cm was prepared in accordance with JIS L-1042-1983, Paragraph 7.

(b) Washing

Washing tests were effected in accordance with the water-washing test of Notice No. 11 of the Fire Defense Board dated June 1, 1973 [Standard for washing resistance on flameproofness (referred to as "Notice No. 11" hereinafter)] in the following manner.

(i) Washing was carried out with water to 60° C. for 75 minutes. The method of Notice No. 11 employs a washing time of 15 minutes, but in this invention, 15 min×5(times)=75 minutes was used.

Thus, the washing test method employed in this invention was the same as the method of Notice No. 11 except for the washing time. A powdered soap (specified in JIS K3303) was used as a detergent in an amount of 1 g per 1 l.

(ii) The washing method of (i) (supply of water of 60° C.→introduction of detergent→introduction of test piece→washing with the solution of 60° C. for 75 minutes→water discharge.water supply.rinsing with water of 40° C. for 5 min.×3times→water discharge→dehydration for 2 min.→drying at 60° C.) was repeated 6 times. Since in the test (i), the washing test was repeated 5 times, the washing was repeated totally 30 times.

(c) Measurement

After completion of the washing, measurement was made in accordance with the method of JIS L-1042-1983: Paragraph 9.

(d) Calculation

Calculation was carried out by the method of JIS L-1042-1083: Paragraph 10. That is, average value of lengths of three lines in lengthwise and breadthwise direction, respectively was obtained and shrinkage was calculated by the following equation and expressed by average value of three times in lengthwise and breadthwise driection, respectively.

$$\text{Progressive shrinkage (\%)} = \frac{L - L'}{L} \times 100$$

L: Length before washing (mm)
L': Length after washing (mm)

(2) Crease (wrinkle) after washing

Measurement was effected in accordance with JIS L1096-1979: 6. 23. 1, method A. Drying was carried out by tumble drying.

(3) Wear Strength

Measurement was effected in accordance with JIS L1096-1079: Paragraph 6. 17. 1 (2), method A-2 (flexing).

(4) Amount of amido-phosphazene compound adhering to fabric after subjected to pressing was obtained by the following equation.

$$\text{Adhering amount of amido-phosphazene compound (\%)} = \frac{[\text{Weight of fabric after adhering of treating solution (g)} - \text{weight of fabric before adhering of treating solution (g)}] \times \text{\% by weight of amido-phosphazene compound in the solution} \times 100}{\text{Weight of fabric before adhering of treating solution (g)}}$$

(5) Carbonization area

This was measured by the combustion test of method A-1 of JIS L1091 (heated for 1 minute by 45° microburner.

(6) Content of phosphorus

Phosphorus content was measured by sulfuric acid decomposition-colorimetry.

Reagent:

1. Sulfuric acid for precision analysis (special grade, 98%)
2. 60% perchloric acid
3. Ammonium molybdate solution: 17.7 g of ammonium molybdate (first class grade) was dissolved in water to make 500 ml of the solution.
4. Ammonium metavanadate solution: 0.6 g of ammonium metavanadate (first class grade was dissolved in water and 100 ml of 60% perchloric acid was added thereto, followed by dilution with water to 500 ml.

Measuring Apparatuses

Chemical balance, 50 ml Kjeldal flask, 10 ml pipette, 5 ml pipette, Kjeldal heat decomposition stand, 25 ml measuring flask, 50 ml measuring flask, 50 ml measuring cylinder, 500 ml measuring flask, 100 ml measuring cylinder, zeolite, spectrophotometer.

Operation

1. Decomposition of Sample

200–300 mg of a bone dried sample was precisely weighed by a chemical balance and put in a 50 ml Kjeldal flask. 5 ml of water, 5 ml of sulfuric acid and 2–3 grains of zeolite (made of glass) were added thereto and the flask was set on a kjeldal heat decomposition stand to carry out heat decomposition. When the sample was carbonized and dissolved in sulfuric acid and turned brown (about 30 minutes after initiation of heating), heating was stopped. After left to stand for 5 minutes, 3 drops of 60% perchloric acid were added and then, heat decomposition was effected again. Heat decomposition—cooling—addition of perchloric acid was repeated until the decomposition solution became colorless and transparent to perform complete decomposition. The decomposition solution was cooled to room temperature and washed out into a 25 ml measuring flask with water and diluted to reach to scale mark.

2. Measurement

The decomposition solution in an amount depending on estimated phosphorus content was weighed and put in a 50 ml measuring flask and 30 ml of water was added thereto, followed by adding 5 ml of an ammonium molybdate solution and 5 ml of an ammonium metavanadate solution and dilution with water until the scale mark. Similarly, blank test was effected. After the decomposition solution was left to stand for 30 minutes, absorbance at 400 nm was measured using the solution of blank test as a control solution.

| Estimated phosphorus content | Amount of decomposition solution |
|---|---|
| 0.5–15% | 0.5 ml |
| 0.1–3% | 2.5 ml |

3. Calculation $$P(\%) = \frac{\frac{25}{\text{amount of decomposition solution}} \times \frac{50}{1000} \times 11.65 \times \text{absorbance} \times 100}{\text{amount of sample (mg)}} = \frac{\frac{12.5}{\text{amount of decomposition solution}} \times 11.65 \times \text{absorbance}}{\text{amount of sample (mg)}}$$

(11.65 mg/l = *Ab* 1.0)

Since phosphorus content in the treated fabric is less than 3%, 2.5 ml of the decomposition solution is applied and calculation was effected by the following equation.

$$P(\%) = \frac{\text{absorbance} \times 11.65 \times 50}{\text{amount of sample (mg)}}$$

(7) Shrinkage in Accordance with Method F-2

Measurement was carried out in accordance with JIS L1042-1983:

(8) Shrinkage According to Method D

This was obtained by JIS L1042-1983: 8.1.4 method D.

(9) Whiteness

Whiteness was measured in accordance with JIS L1013-1981: 7.20 method B (two wavelengths method).

Next, methods of measurements employed in Examples 9–12 are explained below.

(10) Amount of amido-phosphazene compound held by fabric after treatment (% by weight)

Phosphorus content (P%) was obtained by the sulfuric acid decomposition-colorimetry explained hereinabove and the obtained phosphorus content was divided by phosphorus content (0.403) in amido-phosphazene compound to obtain the desired amount.

Amount of amido-phosphazene compound (% by weight) = P/0.403

(11) Method of Measurement of Free Formaldehyde

Measurement was effected in accordance with JIS L1096-1979 6.39.1.2, (1) method B-1.

(12) Method of Measurement of Shrinkage After Washings of 45 Times

Measurement was made in the same manner as in measurement of shrinkage for Examples 1–8 except that the washing in (ii) was repeated 9 times instead of 6 times.

(13) Measurement of Bending Resistance

Measurement was made in accordance with JIS L1096-1979 6.19.3 method C (Kuraku method)

EXAMPLE 1

A muslin woven with viscose rayon staple spun yarns $$\left(\frac{30 \times 30}{68/\text{inch} \times 60/\text{inch}}, \text{weight: } 117\ \text{g/m}^2\right)$$

had been scoured was dipped in a pad bath containing 5% by weight of amido-phosphazene compound comprising about 100% of 6-membered ring, 6.9% by weight of ammonium chloride and 0.2% by weight of nonionic penetrating agent and then was pressed so that amount of the amidophosphazene compound held by the fabric after pressing was 5% by weight of the fabric, followed by drying and curing at 160° C. for 4 minutes. Then, the fabric was dipped in an aqueous solution containing 2% by weight of sodium carbonate and 0.2% by weight of a nonionic penetrating agent, followed by washing with warm water and with water and drying. Thus obtained treated fabric was Sample A, untreated fabric just after scouring was Sample B and conventional resin treated [glyoxal resin (trade name: LFK, amount of application: 10% by weight)] fabric was Sample C. Properties of these samples are shown in Table 1.

TABLE 1

| | Progressive shrinkage (%) | | Crease (wrinkle) after washing (method A tumbling drying) | Abrasion resistance (method A-2) (flexing) (time) | | Free formaldehyde |
|---|---|---|---|---|---|---|
| | warp | filling | (grade) | warp | filling | (μg/g) |
| A | 3.5 | 2.0 | 2.5 | 178 | 170 | 2 |
| B | 11.5 | 6.5 | 1 | 198 | 180 | 2 |
| C | 7.5 | 5.5 | 1.5 | 205 | 198 | 203 |

EXAMPLE 2

The same muslin as used in Example 1 which had been scoured was dipped in a pad bath containing 0.2% by weight of a nonionic penetrating agent, varying amounts of an amido-phosphazene compound comprising about 60% of a 6-membered amido-phosphazene, about 20% of 8-membered or higher cyclic amido-phosphazene compound and about 20% of a linear amido-phosphazene and ammonium chloride in an amount 1.38 time the weight % of the amido-phosphazene. Then, the fabric was pressed to change amount of the amido-phosphazene compound adhering to and held by the fabric after the pressing. Thereafter, each of the fabrics was subjected to drying, curing at 160° C. for 4 minutes, dipping in an aqueous solution containing 3% by weight of sodium carbonate and 0.2% by weight of a nonionic penetrating agent, washing with warm water and then with water and drying. Relations between amount of the amido-phosphazene compound adhering to and held by the thus treated fabric after pressing and various properties are shown in Table 2. According to the results of this Example, warp progressive shrinkage (%) showed substantially no change when amount of the amido-phosphazene compound adhering to the fabric after the pressing was 4% or more. When the amount of the amido-phosphazene compound was 9.9% by weight or more, reduction in abrasion resistance and whiteness due to yellowing was great, resulting in fabrics insufficient in properties desired by consumers. The term "perfect burning" in Table 2 means such state that flame reached the highest position of the test fabric and nearly the whole of the test fabric was burnt and carbonized.

TABLE 2

| | | | | | | |
|---|---|---|---|---|---|---|
| Adhering amount of amido-phosphazene compound (%) | 0 | 1.1 | 1.9 | 3.2 | 4.1 | 5.8 |
| Warp progressive shrinkage (%) | 12 | 8.5 | 6.5 | 5.5 | 4.5 | 4.0 |
| Warp carbonized area of unwashed fabric ($cm^2$) | Perfect burning | Perfect burning | Perfect burning | Perfect burning | Perfect burning | Perfect burning |
| Warp carbonized area of fabric washed 30 times ($cm^2$) | Perfect burning | Perfect burning | Perfect burning | Perfect burning | Perfect burning | Perfect burning |
| Warp wear strength (method A-2) (flexing) (times) | 198 | 176 | 195 | 166 | 180 | 152 |
| Phosphorus content in the treated fabric (%) | 0 | 0.25 | 0.49 | 0.85 | 1.02 | 1.59 |
| Crease (wrinkle) after washing (method A tumbling drying) (grade) | 1.0 | 1.3 | 1.3 | 1.8 | 2.3 | 2.5 |
| Whiteness | 52.0 | 38.7 | 38.9 | 35.6 | 34.2 | 25.3 |
| Adhering amount of amido-phosphazene compound (%) | 6.9 | 8.0 | 9.9 | 15.0 | 20.1 | 24.9 |
| Warp progressive shrinkage (%) | 3.5 | 3.5 | 4.0 | 4.0 | 3.5 | 4.5 |
| Warp carbonized area of unwashed fabric ($cm^2$) | Perfect burning | Perfect burning | 51 | 26 | 23 | 22 |
| Warp carbonized area of fabric washed 30 times ($cm^2$) | Perfect burning | Perfect burning | Perfect burning | Perfect burning | Perfect burning | Perfect burning |
| Warp wear strength (method A-2) (flexing) (times) | 143 | 150 | 80 | 71 | 53 | 22 |
| Phosphorus content in the treated fabric (%) | 1.73 | 2.13 | 2.39 | — | — | — |
| Crease (wrinkle) after washing (method A tumbling drying) (grade) | 2.7 | 3.2 | 3.3 | 3.3 | 3.7 | 3.5 |
| Whiteness | 23.9 | 21.4 | 18.0 | 13.1 | 9.6 | 6.3 |

EXAMPLE 3

A fabric $$\left(\frac{30 \times 30}{68/\text{inch} \times 68/\text{inch}}\text{; weight: } 128\ g/m^2\right)$$

woven with spun yarns consisting of 70% of viscose rayon staples and 30% of polyester which had been scoured was dipped in a pad bath prepared in the same manner as in Example 2 and then pressed to change amount of the amido-phosphazene compound adhering to and held by the fabric after the pressing. Then, each of the fabrics was subjected to drying, curing at 170° C. for 3 minutes, dipping in an aqueous solution containing 0.5% by weight of sodium carbonate and 0.2% by weight of a nonionic penetrating agent, washing with warm water and with water and then drying. Relations between the amount of the amido-phosphazene compound adhering to the fabric after pressing and various properties are shown in Table 3. L Warp progressive shrinkage (%) showed substantially no change when the amount of the amido-phosphazene compound after pressing was 3.3% or more. Approximately 3% was most preferred considering abrasion resistance and whiteness, but flameproofing effect was not exhibited at approximately 3% in the amount of the amido-phosphazene compound adhering to the fabric.

TABLE 3

| | | | | | | |
|---|---|---|---|---|---|---|
| Adhering amount of amido-phosphazene compound (%) | 0 | 0.8 | 1.7 | 2.7 | 3.3 | 5.5 |
| Warp progressive shrinkage (%) | 5.5 | 4.5 | 4.2 | 3.8 | 3.5 | 3.7 |
| Carbonized area in warp direction of unwashed fabric ($cm^2$) | Perfect burning | Perfect burning | Perfect burning | Perfect burning | Perfect burning | Perfect burning |
| Carbonized area in warp direction of fabric washed 30 times ($cm^2$) | Perfect burning | Perfect burning | Perfect burning | Perfect burning | Perfect burning | Perfect burning |
| Phosphorous content in the treated fabric (%) | 0 | 0.17 | 0.34 | 0.54 | 0.71 | 1.14 |
| Adhering amount of amido-phosphazene compound (%) | 6.0 | 6.8 | 8.6 | 12.8 | 17.0 | 21.3 |
| Warp progressive shrinkage (%) | 3.2 | 3.2 | 3.0 | 1.9 | 2.1 | 2.0 |
| Carbonized area in warp direction of unwashed fabric ($cm^2$) | Perfect burning | Perfect burning | Perfect burning | 60 | 45 | 30 |
| Carbonized area in warp direction of fabric washed 30 times ($cm^2$) | Perfect burning | Perfect burning | Perfect burning | Perfect burning | Perfect burning | Perfect burning |
| Phosphorus content in the treated | 1.19 | 1.50 | 1.71 | — | — | — |

TABLE 3-continued

| fabric (%) |
|---|

EXAMPLE 4

An untreated fabric $$\left(\frac{120D \times 150D}{107/\text{inch} \times 72/\text{inch}}\right)$$

woven with viscose rayon filaments was dipped in a pad bath containing 4% by weight of an amido-phosphazene compound which comprised about 60% of a 6-membered amido-phosphazene compound, about 20% by weight of 8-membered or higher cyclic amido-phosphazene compound and about 20% by weight of a linear amido-phosphazene compound and in which about 30% of amido group was substituted with methoxy group (—$OCH_3$), 5% by weight of ammonium chloride, 2% by weight of 85% phosphoric acid and 0.2% by weight of a nonionic penetrating agent and then was pressed so that amount of the amido-phosphazene compound adhering to the fabric after pressing was 4% by weight, followed by drying, curing at 170° C. for 3 minutes, then dipping in an aqueous solution containing 4% by weight of sodium carbonate and 0.3% by weight of a nonionic penetrating agent, washing with warm water and with water and then drying. Thus obtained treated fabric of this invention was called "A" and untreated fabric was called "B". Progressive shrinkages of these fabrics are shown in Table 4.

TABLE 4

| | Progressive shrinkage (%) | |
|---|---|---|
| | Warp | Filling |
| A | 6.0 | 5.0 |
| B | 11.0 | 7.7 |

EXAMPLE 5

A broadcloth (Product No. 7420 and weight: 118 g/m$^2$) woven with spun yarns of 100% cotton which had been scoured was dipped in a pad bath containing 0.3% by weight of a nonionic penetrating agent, 2% by weight of 85% phosphoric acid and varying amounts of amido-phosphazene compound comprising about 60% of 6-membered amido-phosphazene compound, about 20% of 8-membered or higher cyclic amido-phosphazene compound and about 20% of a linear amido-phosphazene compound and ammonium chloride in an amount 1.38 time the amount of the amido-phosphazene compound, and then the fabric was pressed to change the amount of the amido-phosphazene compound adhering to the fabric after the pressing, followed by drying, curing at 170° C. for 4 minutes, dipping in an aqueous solution containing 6% by weight of sodium carbonate and 0.2% by weight of a nonionic penetrating agent, washing with warm water and with water and then drying. Relations between amount of the amido-phosphazene compound adhering to the fabric after pressing and various properties are shown in Table 5. According to the results of this Example, warp progressive shrinkage (%) showed substantially no change when amount of the amido-phosphazene compound adhering to the fabric after the pressing was about 4% or more. About 4% was the best considering abrasion resistance and whiteness.

TABLE 5

| | | | | | | |
|---|---|---|---|---|---|---|
| Adhering amount of amido-phosphazene compound (%) | 0 | 0.9 | 1.9 | 3.0 | 3.8 | 6.1 |
| Warp progressive shrinkage (%) | 8.5 | 6.5 | 5.7 | 4.8 | 3.3 | 2.6 |
| Carbonized area in warp direction of unwashed fabric (cm$^2$) | Perfect burning | Perfect burning | Perfect burning | Perfect burning | Perfect burning | Perfect burning |
| Carbonized area in warp direction of fabric washed 30 times (cm$^2$) | Perfect burning | Perfect burning | Perfect burning | Perfect burning | Perfect burning | Perfect burning |
| Whiteness | 60 | 49.5 | 48.7 | 48.5 | 47.3 | 39.9 |
| Adhering amount of amido-phosphazene compound (%) | 7.0 | 7.9 | 10.0 | 15.1 | 19.8 | 24.8 |
| Warp progesssive shrinkage (%) | 3.0 | 2.8 | 2.0 | 2.5 | 2.1 | 2.0 |
| Carbonized area in warp direction of unwashed fabric (cm$^2$) | Perfect burning | 58 | 30 | 23 | 22 | 23 |
| Carbonized area in warp direction of fabric washed 30 times (cm$^2$) | Perfect burning | Perfect burning | Perfect burning | Perfect burning | Perfect burning | Perfect burning |
| Whiteness | 35.3 | 32.0 | 23.8 | 18.3 | 13.5 | 8.9 |

EXAMPLE 6

A twill fabric $$\left(\frac{20/1 \times 20/2}{154/\text{inch} \times 48/\text{inch}}\right)$$

woven with spun yarns of viscose rayon staple which had been scoured was dipped in an aqueous solution containing 7.0% by weight of the same amido-phosphazene compound as used in Example 2, 9.7% by weight of ammonium chloride and 0.2% by weight of a nonionic penetrating agent and was pressed so that amount of the amido-phosphazene compound adhering to the fabric was 7.0% by weight of the fabric, followed by drying, curing at 160° C. for 3 minutes, then dipping in a solution containing 3% by weight of sodium carbonate and 0.2% by weight of a nonionic penetrating agent, washing with warm water and with water, dipping in a 3% aqueous solution of high-density polyethylene softener, pressing and drying. Thus obtained treated fabric was called "A", a fabric obtained in the same manner as above except that ammonium chloride was not added was called "B" and untreated fabric just after subjected to scouring was called "C". Various properties of these fabrics are shown in Table 6.

TABLE 6

| | Shrinkage (%) method F-2 | | Shrinkage (%) method D | | Progressive shrinkage (%) | | Wrinkle after washing (method A) (tumbling drying) | Abrasion resistance (method A-2) (flexing) (time) | | Free formaldehyde |
|---|---|---|---|---|---|---|---|---|---|---|
| | Warp | Filling | Warp | Filling | Warp | Filling | (grade) | Warp | Filling | (μg/g) |
| A | 0.5 | −1.1 | 0.6 | 1.5 | 4.0 | 3.5 | 3.0 | 530 | 480 | 3 |
| B | 3.5 | 2.0 | 4.5 | 4.0 | 9.5 | 3.0 | 2.0 | 890 | 750 | 4 |
| C | 6.7 | 3.8 | 7.0 | 4.5 | 14.0 | 3.0 | 1.0 | 1450 | 1330 | 4 |

EXAMPLE 7

An interlock fabric of 100% cotton [40S'/16 inches×1600 (25G), weight: 216 g/m$^2$)] which had been scoured was dipped in a treating solution containing 0.2% by weight of a nonionic penetrating agent, varying amounts of 6-membered amido-phosphazene compound and ammonium chloride in an amount 1.44 time the amount of the 6-membered amido-phosphazene compound and each of the treated fabrics was pressed to change amount of the amido-phosphazene compound adhering to the fabric after the pressing and then subjected to drying curing at 160° C. for 1.5 minute. Then, the fabric was dipped in an aqueous solution containing 2% by weight of sodium carbonate and 0.2% by weight of a nonionic penetrating agent, washed with warm water and water and then dried. Relations between the amount of the amido-phosphazene compound adhering to the fabric after pressing and various properties are shown in Table 7.

TABLE 7

| | | | | |
|---|---|---|---|---|
| Adhering amount of amido-phosphazene compound (%) | 0 | 3.0 | 5.0 | 6.9 |
| Warp progressive shrinkage (%) | 20 | 6.2 | 5.0 | 4.9 |
| Carbonized area in warp direction of unwashed fabric (cm$^2$) | Perfect burning | Perfect burning | Perfect burning | Perfect burning |
| Carbonized area in warp direction of fabric washed 30 times (cm$^2$) | Perfect burning | Perfect burning | Perfect burning | Perfect burning |

As is clear from Table 7, there was obtained markedly superior shrink-resistance in cotton knitted fabric, but practical flameproofness was not shown.

EXAMPLE 8

An interlock fabric comprising 100% rayon staple (30S'/20 inches×1500, weight: 210 g/m$^2$) which had been scoured was dipped in a treating solution containing 0.2% by weight of a nonionic penetrating agent, varying amounts of 6-membered amido-phosphazene compound and ammonium chloride in an amount 1.35 time the amount of the 6-membered amido-phosphazene compound and was pressed to change amount of the amido-phosphazene compound adhering to the fabric after the pressing, followed by drying and curing at 160° C. for 1.5 minute. Then, each of the treated fabrics was dipped in an aqueous solution containing 2% by weight of sodium carbonate and 0.2% by weight of a nonionic penetrating agent, washed with warm water and with water and dried. Relations between the amounts of the amido-phosphazene compound adhering to the treated fabric after pressing and various properties are shown in Table 8.

TABLE 8

| | | | | |
|---|---|---|---|---|
| Adhering amount of amido-phosphazene compound (%) | 0 | 3.5 | 5.1 | 6.7 |
| Warp progressive shrinkage (%) | 21.0 | 11.5 | 10.0 | 9.5 |
| Carbonized area in warp direction of unwashed fabric (cm$^2$) | Perfect burning | Perfect burning | Perfect burning | Perfect burning |
| Carbonized area in warp direction of fabric washed 30 times (cm$^2$) | Perfect burning | Perfect burning | Perfect burning | Perfect burning |

As is clear from Table 8, remarkable reduction of warp progressive shrinkage was obtained in rayon knitted fabric. No flameproofness was obtained at these adhering amount of the amido-phosphazene compound. The surface of the fabrics of this invention treated in the above examples after subjected to measurement of progressive shrinkage (washings of 30 times were carried out) was smooth and glossy and substantially the same as before washing. On the other hand, the untreated fabric just after scouring had much fluffing and showed so-called "fibrization or Peach skin" and besides gloss was lost. Thus, it had no commercial values.

EXAMPLE 9

A muslin of staple fibers $$\left(\frac{30/1 \times 30/1}{68 \times 60}\right)$$

which had been scoured was dipped in a pad bath containing 70 g/l of amido-phosphazene compound mainly composed of 6-membered compound and further containing 8-membered or higher macrocyclic compounds and linear compound, 97 g/l of ammonium chloride and 3 g/l of a nonionic penetrating agent and then was pressed, followed by drying, curing at 150° C. for 4 minutes, then dipping in an aqueous solution containing 20 g/l of sodium carbonate and 2 g/l of a nonionic penetrating agent, washing with warm water and water and drying. Thus treated fabric showed no change in hand and had drape peculiar to staple. Properties of thus obtained fabric are shown in Table 9.

COMPARATIVE EXAMPLE 1

The same muslin of staple as used in Example 9 was dipped in a pad bath containing 150 g/l of a nonformalin staple treating agent (trade name: Beckamine NF-5 manufactured by Dainippon Ink & Chemicals Inc.), 40 g/l of a composite metal type catalyst (trade name: Catalyst GT manufactured by Dainippon Ink & Chemicals Inc.) and 3 g/l of a nonionic penetrating agent and then was pressed. This fabric was then subjected to the same treatment as in Example 9 and properties of thus obtained fabric are shown in Table 9. This fabric became somewhat harder owing to the treatment and the drape peculiar to staple was somewhat lost.

EXAMPLE 10

A polynosic fabric $$\left(\frac{60/1 \times 40/1}{70 \times 40}\right)$$

which had been dyed was dipped in a pad bath containing 40 g/l of the same amido-phosphazene compound as used in Example 9, 55 g/l of ammonium chloride and 3 g/l of a nonionic penetrating agent and then was pressed, followed by drying, curing at 160° C. for 4 minutes. Thereafter, the fabric was subjected to the same neutralization as in Example 9, washing with warm water and then water and drying. Properties of thus treated fabric are shown in Table 9.

COMPARATIVE EXAMPLE 2

The same polynosic fabric as used in Example 10 was dipped in a pad bath containing 100 g/l of Beckamine NF-5, 40 g/l of Catalyst GT and 3 g/l of a nonionic penetrating agent and then was pressed. Then, the fabric was subjected to the same treatment as in Example 10. Properties of thus treated fabric was shown in Table 9.

EXAMPLE 11

A cotton fabric $$\left(\frac{10/1 \times 10/1}{80 \times 45}\right)$$

which had been dyed was dipped in a pad bath containing 70 g/l of the same amido-phosphazene compound as used in Example 9, 97 g/l of ammonium chloride, 20 g/l of phosphoric acid and 3 g/l of a nonionic penetrating agent and then was pressed. This fabric was then dried, cured at 170° C. for 3 minutes, dipped in an aqueous solution containing 40 g/l of sodium carbonate and 2 g/l of a nonionic penetrating agent, washed with warm water and then water and then dried. Properties of thus treated fabric are shown in Table 9.

COMPARATIVE EXAMPLE 3

The same cotton fabric as used in Example 11 was dipped in a pad bath containing 150 g/l of a nonformalin cotton treating agent (Beckamine NF-8), 40 g/l of Catalyst GT and 3 g/l of a nonionic penetrating agent and was pressed, followed by the same treatments as in Example 11. Properties of thus treated fabric are shown in Table 9.

EXAMPLE 12

A hemp fabric $$\left(\frac{36 \times 36}{74 \times 62}\right)$$

which had been dyed was dipped in a pad bath containing 60 g/l of the same amido-phosphazene compound as used in Example 9, 83 g/l of ammonium chloride and 3 g/l of a nonionic penetrating agent and then was pressed. Then, this fabric was subjected to the same treatments as in Example 9. Properties of thus treated fabric are shown in Table 9.

COMPARATIVE EXAMPLE 4

The same hemp fabric as used in Example 12 was dipped in a pad bath containing 100 g/l of Beckamine NF-8, 40 g/l of Catalyst GT and 3 g/l of a nonionic penetrating agent and was pressed. Then, this fabric was subjected to the same treatments as in Example 12. Properties of thus treated fabric are shown in Table 9.

TABLE 9

| | Phosphorus content in the fabric (% by weight) | Content of amido-phosphazene compound in fabric (% by weight) | Free formaldehyde (μg/g) | Shrinkage after washing of 45 times Warp | Filling | Bending resistance |
|---|---|---|---|---|---|---|
| Example 9 | 1.78 | 4.4 | 2 | 2.0 | 3.0 | 38 mm |
| Example 10 | 1.62 | 4.0 | 1 | 1.0 | 1.5 | |
| Example 11 | 2.29 | 5.7 | 1 | 1.5 | 0.5 | |
| Example 12 | 1.57 | 3.9 | 2 | 2.5 | 2.5 | |
| Comparative Example 1 | — | — | 1 | 8.0 | 5.0 | 45 mm |
| Comparative Example 2 | — | — | 2 | 9.5 | 2.3 | |
| Comparative Example 3 | — | — | 1 | 8.5 | 2.7 | |
| Comparative Example 4 | — | — | 2 | 7.5 | 2.1 | |

the non-formaldehyde type low shrinkage fabric of this invention is markedly low in shrinkage after repeated washings, shows further higher shrink-resistance than that obtained by aminoplast resin treatment which causes skin troubles due to formaldehyde, shows substantially no hardening due to the treatment and retains excellent softness and hence is especially useful as cloths which contact with skin. Thus, it has a very high practical value.

What is claimed is:

1. A method for treating a fabric containing cellulosic fibers to reduce shrinkage which comprises applying an aqueous solution containing an amido-phosphazene compound and an acid catalyst to said fabric so that the amount of the amido-phosphazene compound adhering to the fabric is from 2 to 7% by weight of the fabric and then subjecting the fabric to drying, curing and soaping.

2. A method according to claim 1 wherein the fabric contains at least 65% of viscose rayon, high-tenacity viscose rayon, polynosics or cuprammonium rayon.

3. A method according to claim 1 wherein the amido-phosphazene compound is a 6-membered amido-phosphazene.

4. A method according to claim 1 wherein the amido-phosphazene compound is a mixture of 6-membered amido-phosphazene, 8-membered amido-phosphazene and linear amido-phosphazene.

5. A method according to claim 1 wherein the amido-phosphazene compound is a cyclic amido-phosphazene represented by the general formula

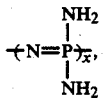

wherein x is an integer of 3 or more, or a linear amido-phosphazene compound represented by $P_nN_n(NH_2)_{2n}$ or $P_nN_{n-1}(NH_2)_{2n+3}$, wherein n is a positive integer.

6. A method according to claim 1 wherein the acid catalyst is ammonium secondary phosphate, ammonium chloride, organic amine hydrochlorides, zinc chloride, magnesium chloride, zinc nitrate, zinc borofluoride, hydrochloric acid or phosphoric acid.

7. A method according to claim 1 wherein concentration of amido-phosphazene compound in the aqueous solution is 0.5–15% by weight.

8. A method according to claim 1 wherein concentration of the acid catalyst in the aqueous solution is 0.01–14% by weight.

9. A method according to claim 1 wherein the application of the aqueous solution to the fabric is carried out by dipping, spraying or coating.

10. A method according to claim 1 wherein the amido-phosphazene compound in which a small amount of amido groups are substituted with —Cl, —$OCH_3$, —$OC_2H_5$, —$OC_3H_7$ or —OH.

11. A fabric containing cellulosic fibers which have adhering thereto 6% or less, based on weight of untreated fabric, of an amido-phosphazene compound and 10 μg/g or less of free formaldehyde and having a shrinkage of 4% or less after 45 washings.

* * * * *